United States Patent [19]

Meissenburg

[11] Patent Number: 4,804,010

[45] Date of Patent: Feb. 14, 1989

[54] FAUCET ASSEMBLY

[76] Inventor: Loyd G. Meissenburg, 208 S. Barranca, Sp. 39, Glendora, Calif. 91740

[21] Appl. No.: 167,866

[22] Filed: Mar. 14, 1988

[51] Int. Cl.[4] ..... F16K 24/00

[52] U.S. Cl. ..... 137/216; 4/192; 137/359; 137/801

[58] Field of Search ..... 4/192; 137/216, 359, 137/801

[56] References Cited

U.S. PATENT DOCUMENTS

| | | | |
|---|---|---|---|
| 3,183,923 | 5/1965 | Henrikson | 137/216 |
| 3,620,241 | 11/1971 | Brown | 137/216 |
| 3,790,966 | 2/1974 | Keane | 4/192 |
| 4,210,533 | 7/1980 | Astl | 137/216 X |
| 4,399,832 | 8/1983 | Appleby | 137/216 |
| 4,548,224 | 10/1985 | McLaughlin | 4/192 |

*Primary Examiner*—Robert G. Nilson
*Attorney, Agent, or Firm*—Boniard I. Brown

[57] ABSTRACT

A sink faucet having an anti-syphon device incorporated therein. The anti-syphon device serves as part of a clamping mechanism used to mount the faucet on a sink deck. The complete assembly can be accommodated on a conventional sink structure without structural modifications to the sink.

9 Claims, 1 Drawing Sheet

FAUCET ASSEMBLY

BACKGROUND OF THE INVENTION

This invention relates to a sink faucet having an anti-syphon device incorporated therein. The anti-syphon device has a water inlet designed to fit onto a hose extending from a dishwasher. A water outlet is provided on the anti-syphon device to discharge water into a second hose leading to the drain. One or more vent openings are formed in the anti-syphon device to prevent the formation of a vacuum that could otherwise produce a backflow of water from the drain into the dishwasher, or from the dishwasher into the water supply.

In certain respects my invention may be considered an improvement on the devices shown in the U.S. Pat. No. 3,183,923 to R. E. Henrikson and U.S. Pat. No. 4,399,832 to R. A. Appleby.

SUMMARY OF THE INVENTION

Under conventional practice the sink faucet and anti-syphon device have been constructed as separate devices. My invention combines the two devices into on unitary assembly.

One object of my invention is to provide a faucet/anti-syphon assembly wherein the anti-syphon device constitutes part of a clamp system for retaining the faucet on a sink deck.

Another object is to provide a faucet/anti-syphon assembly that occupies the same planar space as a conventional faucet.

A further object is to provide a faucet/anti-syphon assembly that can be mounted on a sink deck without requiring additional mount openings in the deck, beyond those openings required or mounting a conventional faucet.

A still further object is to proved a faucet/anti-syphon assembly that can be mounted on a sink deck in a minimum time, hence at minimum installation expense.

THE DRAWINGS

DESCRIPTION OF A PREFERRED EMBODIMENT OF THE INVENTION

Figure 1:
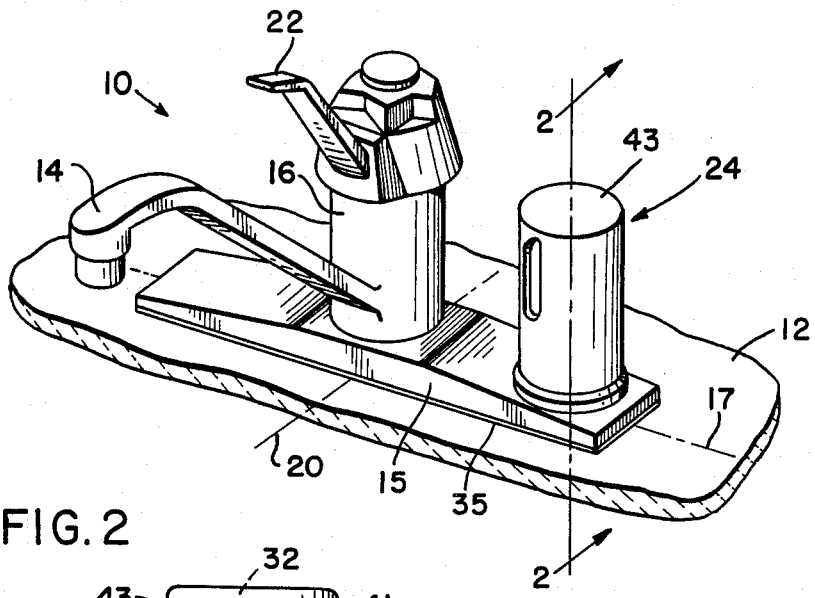
FIG. 1 is a perspective view of a faucet/anti-syphon device assembly embodying my invention.

FIG. 1 shows a faucet-antiphonal device assembly 10 mounted onto the deck area 12 of a kitchen sink. The bowl area of the sink (not shown) would be located below a rotary spigot structure 14 carried on a faucet valve body 16.

Assembly 10 comprises a baseplate 15 having a laterally-extending centerline 17 and a front-to-rear centerline 20. Valve body 16 extends upwardly from baseplate 15 at the intersection of the two centerlines; spigot structure 14 has a swivel fit on the outer surface of the valve body.

Streams of hot and cold water are supplied to valve body 16 through separate tubes (usually copper) that depend from the valve body through a non-illustrated opening in deck 12. A lever-type handle 22 is provided to operate valve components within body 16, for achieveing a desired water flow and water temperature through spigot structure 14. The illustrated faucet is of the "single lever" type, in contradistinction to the older "dual knob" types also used in kitchen faucet construction.

Assembly 10 comprises an anti-syphon device 24 spaced laterally from valve body 16 on centerline 17. Device 24 includes a cylindrical hollow body 26 extending vertically through aligned openings 27 and 30 in baseplate 15 and sink deck 12. A first nut 32 is threaded onto a threaded section of body 26 to form a downwardly-facing shoulder-type support surface. A second nut 34 is threadable onto the hollow body to clamp the anti-syphon device onto baseplate 15. Nut 34 also clamps baseplate 15 onto sink deck 12. Baseplate 15 may include a compressible gasket 35.

Hollow body 26 is constructed generally similarly to hollow body 11 in aforementioned U.S. Pat. No. 4,399,832, except that body 26 includes a roof 32 that is integral with the outer tubular wall of the body. A water inlet tube 33 connects with a vertical passage 36 in body 26. A water outlet tube 37 connects with a vertical passage 39 in body 26. The two vertical passages 36 and 39 communicate with a free space 41 (defined in part by roof 32) to form a generally inverted U-shaped passage structure within body 26.

Inlet tube 33 is designed to receive a non-illustrated hose leading from the dishwasher exhaust pump. Outlet tube 37 is designed to receive a non-illustrated hose leading to the household drainage system. Water flow (with contaminates) is in the direction shown by the arrows in FIG. 2.

Figure 2:
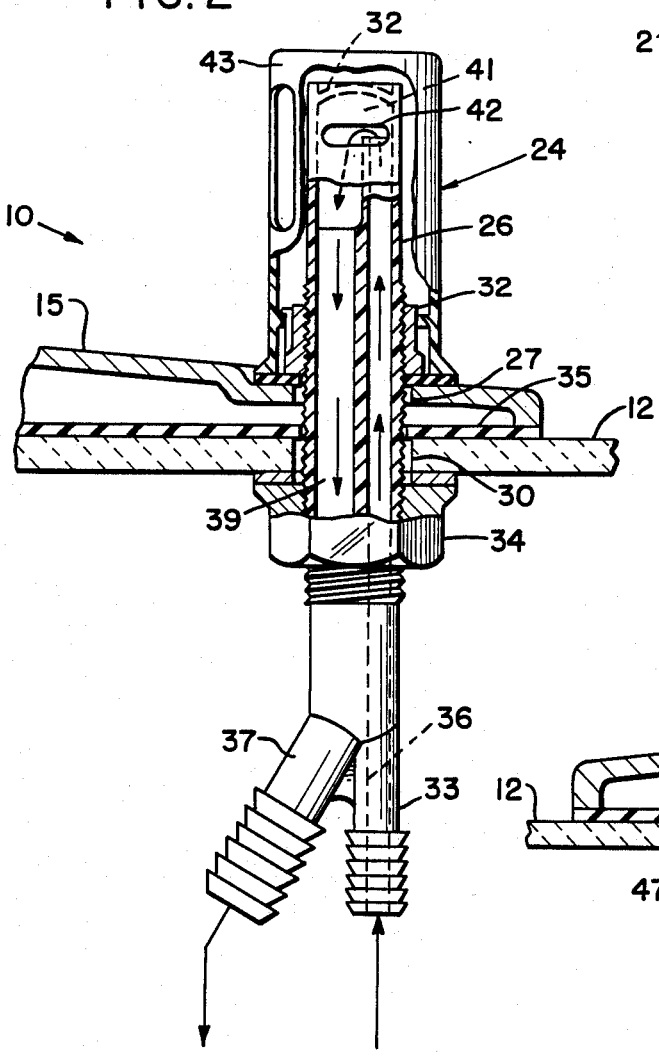
FIG. 2 is a fragmentary sectional view taken on line 2—2 in FIG. 1.
Figure 4:
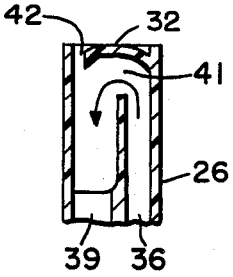
FIG. 4 is a fragmentary sectional view illustrating a structural detail that can be employed in the FIG. 1 assembly.
Figure 3:
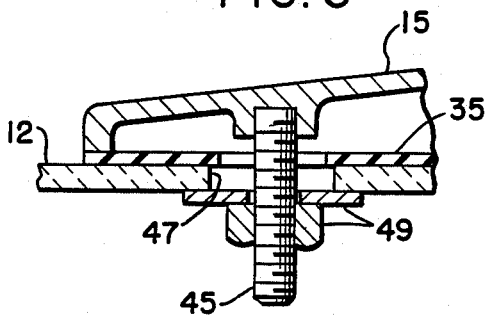
FIG. 3 is a fragmentary sectional view taken through another portion of the FIG. 1 device.

Hollow body 26 is formed with at least one air vent opening 42 in an upper wall section of the defined U-shaped passage. FIG. 2 shows the vent opening in the tubular side wall of the hollow body. FIG. 4 shows the vent opening in the roof section of the hollow body. Vent opening 42 enables space 41 to serve as an air gap for preventing reverse water flow.

An ornamental cap 43 is removably installable on nut 32 to conceal body 26 from view. Cap 43 may be constructed similarly to cap 41 in U.S. Pat. No. 4,399,832. An endless internal flange on the cap is seatable on undersurface areas of tabs formed on nut 42 to retain cap 43 in position.

As thus far described, assembly 10 is retained on sink deck 12 by means of nut 34. However, to ensure a fully satisfactory retention of the assembly an additional threaded member (stud) 45 may be secured to baseplate 15 near its left end, i.e. the end remote from anti-syphon device 24. Member 45 is designed to extend downwardly from the baseplate through a second opening 47 in sink deck 12. A nut-washer mechanism 49 is threadable onto member 45 to exert a clamp force on the undersurface of deck 12.

Faucet body 16 is located at a central point on baseplate 15. The two threaded members 26 and 45 are located equi-distantly from valve body 16. Preferably the two nut mechanisms 34 and 49 are the only clamping members used to clamp assembly 10 to the sink deck.

The faucet-antiphonal assembly 10 can be constructed to have the same planar dimension (face area of baseplate 15) as a conventional faucet. Thus, the anti-syphon device does not utilize any extra space.

It should also be noted that the anti-syphon device serves as part of the clamp system for the faucet assembly (body 16 and baseplate 15). The number of parts for the faucet/anti-syphon assembly is fewer than the number of parts for a corresponding faucet and separate anti-syphon device.

It will also be noted that the illustrated arrangement uses the same number of mount openings in the sink that would be used to mount a conventional faucet (without the anti-syphon device). My improved arrangement can be used with conventional sinks (without punching additional openings in the sink deck).

Installation of the assembly can be accomplished more quickly than two separate devices (faucet and anti-syphon device). In service the assembly is somewhat easier to clean, compared to a separate faucet and anti-syphon device, since baseplate 15 is the sole structure projecting from the sink deck.

The invention may be practiced with some variations in structural detail. For example, the second threaded member 45 may be a tubular support structure for a conventional hose-spray assembly (commonly used to rinse dishes, etc.). Other structural modifications are possible while still practicing the invention.

The inventor claims:

1. A faucet having an anti-syphon device incorporated therein and comprising a baseplate adapted to seat on the upper face of a sink deck, and a valve body projecting upwardly from a central point on the baseplate, said anti-syphon device comprising:

a cylindrical hollow body having an externally threaded section extending through aligned openings in the baseplate and sink deck, a tubular water inlet means connected to said hollow body at a point below the sink deck, a tubular water outlet means connected to said hollow body at a point below the sink deck, said hollow body defining an inverted U-shaped passage having two connected vertical legs communicating respectively with said inlet means and said outlet means, and at least one air vent opening in an upper wall section of the U-shaped passage for preventing a vacuum condition therein, shoulder means carried by the hollow body for seating on an upper face of the baseplate, and nut means threadable on the threaded section of the hollow body to clamp the faucet and anti-syphon device onto the sink deck.

2. The faucet and anti-syphon device of claim 1, and further comprising:

a threaded member extending downwardly from the baseplate for extension through a second opening in the sink deck, and second nut means threadable on said threaded member to exert a clamp force on the sink deck.

3. The faucet and anti-syphon device of claim 2, wherein:

the cylindrical hollow body and threaded member are located equidistantly from the valve body.

4. The faucet and anti-syphon device of claim 3, wherein:

the valve body, hollow body, and threaded member having vertical centerlines located in a common plane bisecting a minor dimension of the baseplate.

5. The faucet and anti-syphon device of claim 3, wherein:

said first and second nut means are the only clamping members operable to hold the faucet on the sink deck.

6. The faucet and anti-syphon device of claim 3, and further comprising:

a spigot structure having a swivel fit on said valve body, and a single lever operator mounted on the valve body for controlling the water flow and water temperature discharged from the spigot structure.

7. In a faucet assembly that comprises an elongated baseplate constructed to seat on a deck area of a sink behind the sink bowl, a single lever faucet body mounted at a central point on the baseplate, and a spigot structure swivably mounted on the faucet body for swinging motion in the space above the sink bowl, the improvement comprising:

means for mounting the baseplate on the sink deck, said mounting means comprising two spaced openings in the deck, a first threaded member depending from the baseplate through one of the openings, first nut means carried by the first threaded member for clamping engagement with the undersurface of the deck, a second hollow threaded member extending through the baseplate and the other opening in the deck, said hollow threaded member having a shoulder means and a second nut means carried thereon for clamping the baseplate and sink deck therebetween, said hollow threaded member having an inverted U-shaped passage therethrough, and a vent opening communicating with an upper section of said passage whereby said hollow member serves as an anti-syphon device.

8. The faucet assembly of claim 7, wherein:

the threaded members are located at opposite ends of the elongated baseplate equidistantly from the faucet body.

9. The faucet assembly of claim 8, wherein:

the two threaded members and associated nut means constitute the sole mechanism for mounting the baseplate on the sink deck.

* * * * *